United States Patent [19]

Kochemidov et al.

[11] 4,005,550

[45] Feb. 1, 1977

[54] MACHINE FOR MAGNETICALLY POLISH-GRINDING WORK PIECES HAVING LARGE DIMENSIONS

[75] Inventors: Atanas Dimitrov Kochemidov; Boris Georgiev Makedonski; Ivan Minkov Dumanov; Stefan Georgiev Payakov, all of Sofia, Bulgaria

[73] Assignee: Znitmash of Chaussee za Gara Izkar, Sofia, Bulgaria

[22] Filed: Apr. 7, 1975

[21] Appl. No.: 565,781

Related U.S. Application Data

[63] Continuation-in-part of Ser. No. 336,896, Feb. 28, 1973, abandoned.

[30] Foreign Application Priority Data

Feb. 28, 1972 Bulgaria ..... 19845

[52] U.S. Cl. ..... 51/56 R; 51/118

[51] Int. Cl.[2] ..... B24B 5/02

[58] Field of Search ..... 51/34 C, 34 D, 34 E, 51/42, 56, 114, 118, 289 R, 292, 325, 328; 125/13

[56] References Cited

UNITED STATES PATENTS

| | | | |
|---|---|---|---|
| 588,441 | 8/1897 | Kann | 51/292 X |
| 1,043,475 | 11/1912 | Smith | 125/13 R |
| 1,737,159 | 11/1929 | Johannessen | 51/56 |
| 1,957,568 | 5/1934 | Wills | 51/118 |
| 2,312,161 | 2/1943 | Hartman | 51/42 |
| 2,819,572 | 1/1958 | Lewis | 51/289 R |
| 3,898,769 | 8/1975 | Makedonski | 51/292 X |

FOREIGN PATENTS OR APPLICATIONS

| | | | |
|---|---|---|---|
| 23,845 | 11/1899 | United Kingdom | 51/292 |

*Primary Examiner*—Al Lawrence Smith
*Assistant Examiner*—Nicholas P. Godici
*Attorney, Agent, or Firm*—Armstrong, Nikaido & Wegner

[57] ABSTRACT

A machine is provided for magnetically polish-grinding work pieces having large dimensions. The machine comprises round electromagnetic heads on both sides of a rotating work piece. The heads are rotatable and concurrently displaceable both laterally and longitudinally with respect to the workpiece.

3 Claims, 3 Drawing Figures

MACHINE FOR MAGNETICALLY POLISH-GRINDING WORK PIECES HAVING LARGE DIMENSIONS

This application is a continuation-in-part of my copending application Ser. No. 336,896 filed Feb. 28, 1973, now abandoned.

BACKGROUND OF THE INVENTION

1. Field of the Invention

The present invention relates to a machine for the magnetic polish-grinding of work pieces having large dimensions by means of round electromagnetic heads and ferromagnetic powder.

2. Description of the Prior Art

There is known a machine for magnetically polish-grinding work pieces, particularly work pieces having small dimensions, in connection with which there is transmitted to the work piece a combined motion which is a combination of rotation about its longitudinal axis and oscillation about the same axis. On both sides of the work piece are positioned electromagnetic coils, whose poles lie at a certain distance from the machined outer surfaces. The ferromagnetic powder for the polishing operation is introduced into the gap so formed. The entire electromagnetic system can be moved on tracks (guides) whereupon it is possible to work upon work pieces having greater lengths.

A disadvantage of this machine resides in the impossibility to work on work pieces having large dimensions, especially those of large length and weight. This drawback results from the fact that it is necessary in order to achieve a good quality outer surface to employ an oscillating motion along the longitudinal axis of the work piece. This oscillating motion is of a relatively high frequency, which is not permissible for heavy and long work pieces as a result of the very large inertial forces existing therewith.

SUMMARY OF THE INVENTION

It is an object of the present invention to overcome the disadvantages described above by the provision of a machine which makes possible the magnetic polish grinding of work pieces having large dimensions.

The foregoing object of the invention is accomplished by providing that the work piece is given only a rotating movement and providing that round electromagnetic heads of opposite polarity having their own rotary movement are arranged on both sides of the work piece, the electromagnetic heads being capable of simultaneous lateral and longitudinal displacement with respect to the work piece. One of the advantages of the new machine is the possibility to thereby work upon workpieces having large dimensions (length and diameter), because its chucking device, for example, between a universal chuck head, is a problem which has already been solved.

Another advantage of the invention is the use of electromagnetic heads having their own rotating movements, whereby the necessity of a longitudinal oscillation of the workpiece is eliminated while the ferromagnetic powder which is attracted by the electromagnetic heads provides the second movement.

A third advantage of the machine in accordance with the present invention resides in the fact that the electromagnetic heads, together with the support upon which they are attached, can move longitudinally with carefully controlled operation. This makes possible short stroke honing of work pieces of the type, for example, of ball joint units or worm gears for presses and pumps, for which at the present time no process and/or machine is known.

A fourth advantage of the machine in accordance with the present invention resides in the opposite polarity of the magnetic heads. This results in the formation of a magnetic circuit between the heads, thereby improving orientation of the abrasive particles and thus producing a more effective apparatus.

BRIEF DESCRIPTION OF THE DRAWINGS

The structure and operation of the machines in accordance with the present invention will be better understood with reference to the drawings, wherein an illustrative embodiment is set forth.

DETAILED DESCRIPTION OF THE PREFERRED EMBODIMENT

Figure 1:
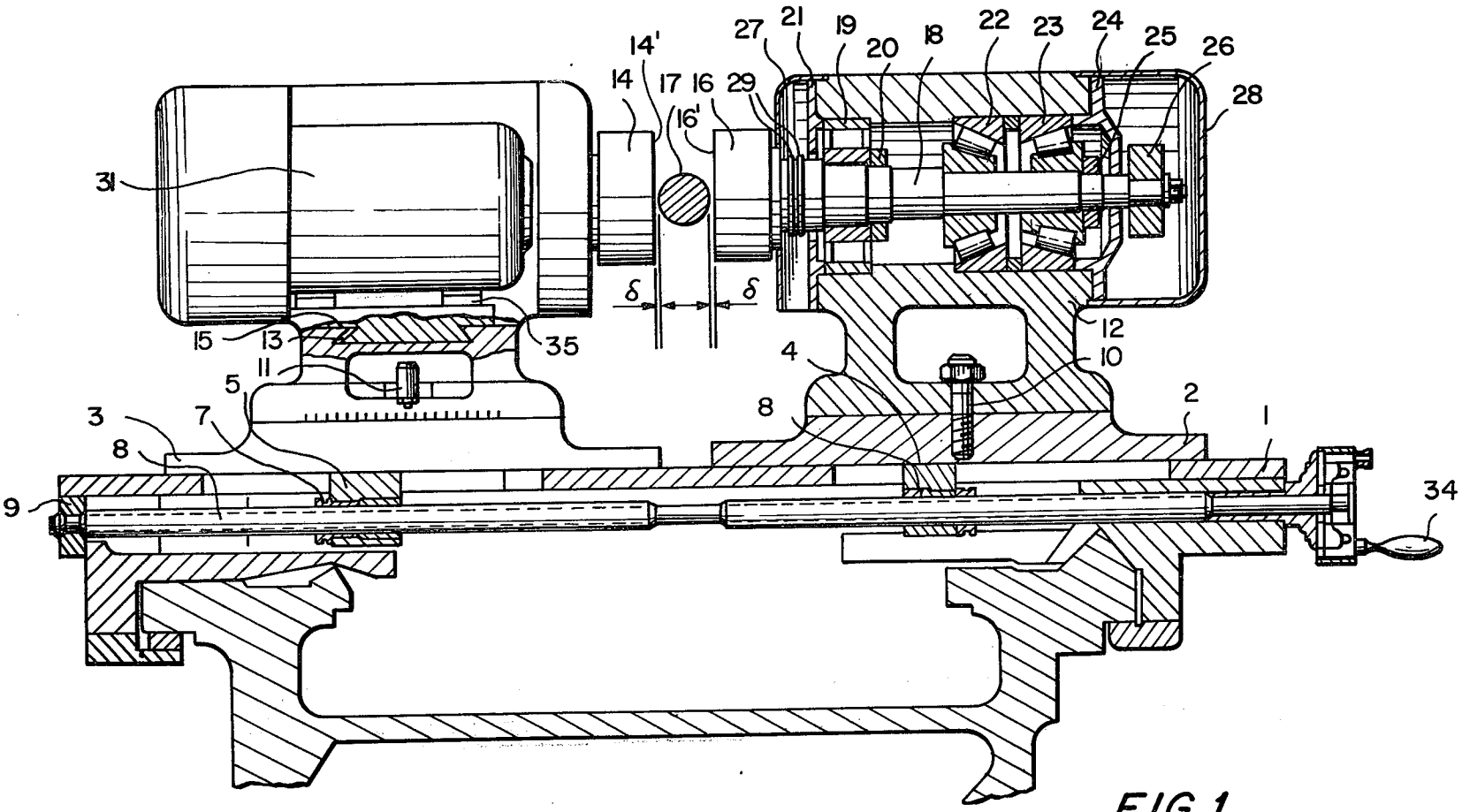
FIG. 1 is a cross section elevation of the machine taken through the electromagnetic heads (along the line A—A in FIG. 3).
Figure 2:
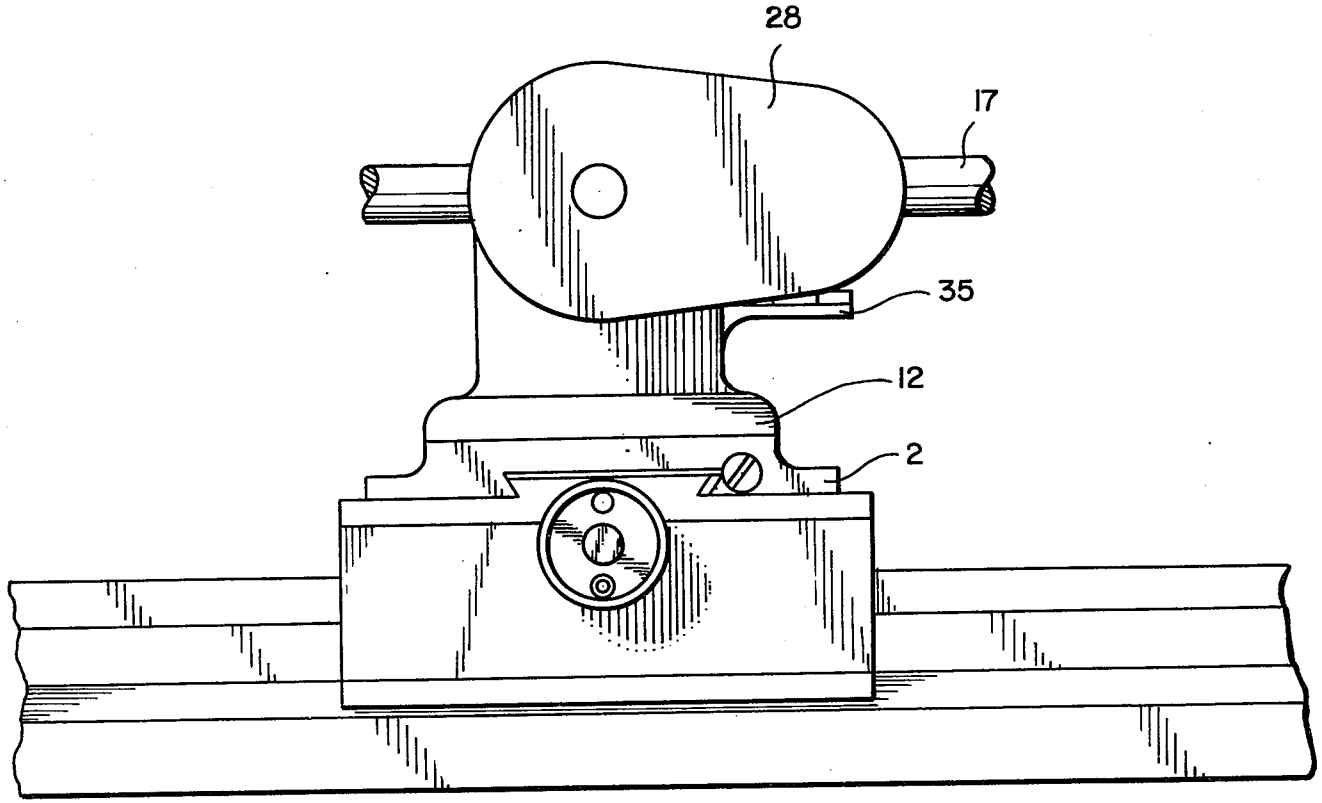
FIG. 2 is a front view of the electromagnetic heads (taken in the direction B of FIG. 1).
Figure 3:
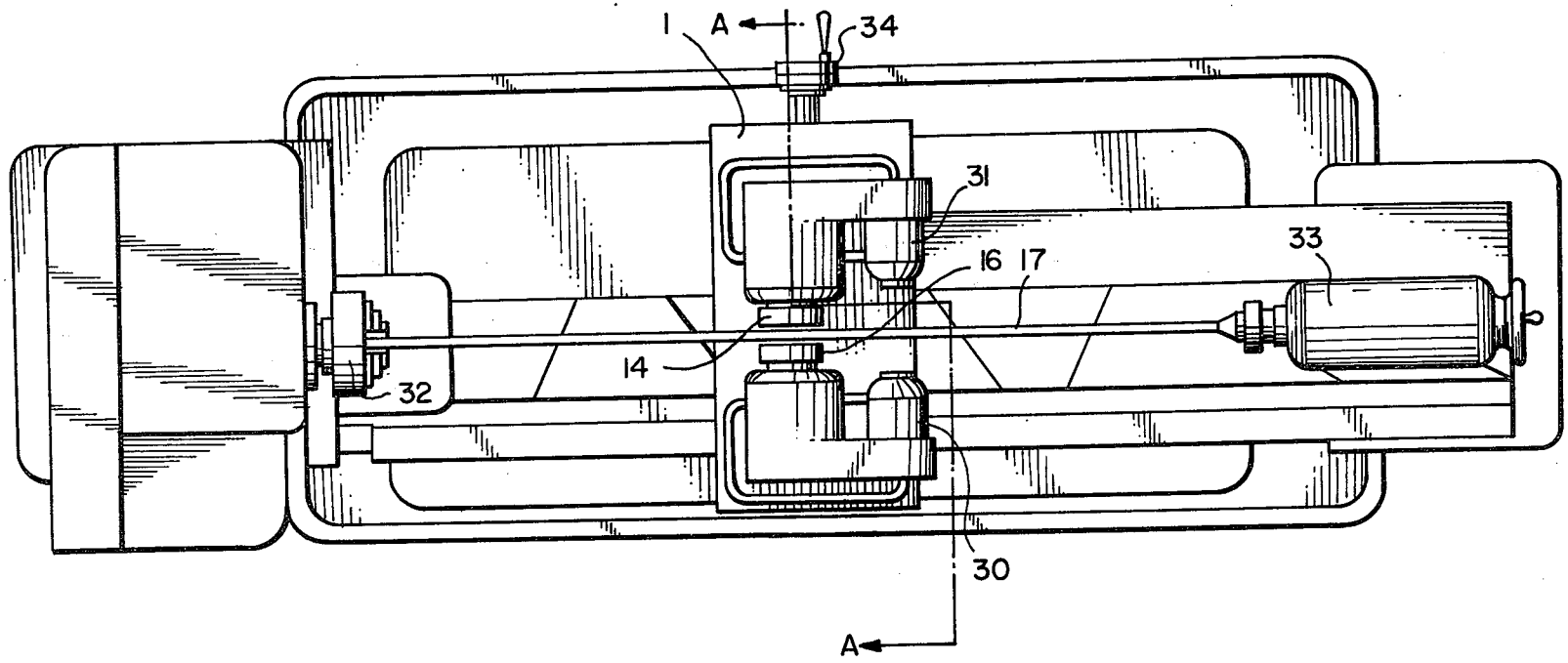
FIG. 3 is a top view of the entire machine.

The illustrated embodiment is similar to a lathe. Mounted on the support plate 1 are the transverse supporting members 2 and 3, which can be displaced on the dovetail guides. Under each of the supports 2 and 3 is located a console 4 or 5, wherein in each is mounted a guiding nut 6 and 7. Through these nuts, the guiding screw 8 can be moved back and forth through left and right turning, so that with the rotation in the one direction, the guiding nuts 6 and 7 move closer to the middle, whereas by the rotation in the opposite direction, they move further apart from one another. The guiding screw 8 is conventionally mounted in the bearing console, which is supported on the rear end of the support plate 1.

Supports 12 and 13 are fastened on the transverse supports 2 and 3 by means of bolts 10 and 11. On the outer cylindrical part of the supports 12 and 13 are placed calibration marks; in this manner it is possible to fix them at a particular angle by turning. This is important for the working of conical surfaces or for bringing the heads into proximity on the threads of the threaded portion of work pieces such as bolts, screws and the like. In this case, in order to accomplish a meeting of the edge of the electromagnetic head 14 in the channel of the thread, it must be possible for it to be moved along the guides 15, for example, by means of a nut and bolt (which are not illustrated in the drawings).

The electromagnetic heads 14 and 16 comprise a conventional coil which is formed from a steel core and is wrapped on the outside with a steel sleeve (casing). Upon connection of the coil to a source of direct current, the core and casing form the poles of a magnet. The heads 14 and 16 are connected to the source of direct current, so that the heads are of opposite magnetic polarity. Both electromagnetic heads are arranged at a distance $\delta$ from the work piece. In the vicinity of every electromagnetic head "working brushes" of ferromagnetic powder are formed on faces 14' and 16' of the heads 14 and 16.

The electromagnetic heads are coupled to the corresponding axle 18. It is preferable that the positioning take place over a part not having magnetic properties;

however, the absence of such a part does not have any particular influence upon the arrangement; especially in the case when a periodical change of the electromagnetic pole takes place as a result of switching of the electrical polarity. A radial roller bearing 19 is pressed against the axle 18, is fixed there by means of the nut 20, is limited from the outside by means of the front cover 21, and is sealed against the axle 18 in conventional manner. The supporting of the axle 18 is accomplished by 2 conical bearings 22 and 23 which are fixed on the support 12 by means of the rear cover 24 and are fixed on the axle 18 by means of the nut 25. The drive pulley 26 is mounted on the rear end of the axle 18. The two covers, in the front 27 and the rear 28, contribute to the compactness of the system.

The electrically conducting rings 29 are mounted in the vicinity of the forward end of the axle and are insulated therefrom. They are connected with the leads of the coils and are connected to the source of direct current by means on the sides of the supports 12 and 13. DC motors 30 and 31 are mounted on supports 12 and 13 and transfer the motor torque to the pulleys 26 by means of belts and pulleys.

The mode of operation of the machine is described hereinbelow:

The work piece 17 is secured in position in the known manner, for example, between a universal chuck 32 and a spindle in the tailstock 33. If it is necessary, a back rest can be used. Both transverse supports 2 and 3 are lifted by means of a lever 34 in the direction of the surface of the work piece 17 to be worked upon until the required working gap is achieved. The work piece 17 is set in motion, i.e. in rotation (the direction is not critical), whereby the selected speed of rotation of the machine is chosen such that it corresponds to the diameter of the work piece, the desired degree of finish and the type of the work piece. The current to which the electromagnetic heads 14 and 16 are connected is turned on. Then, the ferromagnetic powder is introduced and is immediately oriented in such a manner that its sharp cutting points are directed toward the working surface. The electromagnetic heads 14 and 16 are also set in rotation by direct current motors 31 and 30. The speed of rotation of the electromagnetic heads can be varied over a wide range and depends primarily upon the rotational speed of the work piece and the type of working surface involved.

All of these working operations culminate at one end of the workpiece 17, whereby the traversing mechanism of the support is initiated. In the case of working of threaded surfaces, the system of worm drive and separate nuts on the support is used, and the corresponding threaded path is employed. The final degree of finish of the work surface should not be less than 7, and it is possible to achieve a degree of 13 by employing a plurality of passes through the machine. In this manner, mistakes or imperfections in the previous run are for the most part eliminated.

The application of a suitable cutting and cooling liquid (in conventional manner) in the working region may be desirable.

The sense of the invention is not altered in the case where the working process is carried out using only a single electromagnetic head. With the help of a conically shaped straight edge, it is possible to also machine various conical surfaces.

We claim:

1. A machine for magnetically polish-grinding work pieces having large dimensions, said machine comprising:

a. workpiece holding means for holding said work piece;

b. work piece rotating means for rotating said work piece holding means about a first axis and thereby rotating said work piece about said first axis;

c. rotating electromagnetic head means, said head means rotating about a second axis perpendicular to said first axis, said head means comprising first and second magnetic heads positioned on opposite sides of said work piece such that the faces of said heads face said work piece and first and second drive means for independently rotating said first and second heads respectively, wherein said first and second drive means are independent of said work piece rotating means;

d. support means for holding said first and second heads and simultaneously moving said first and second heads in a direction along said second axis, said support means movable parallel to said first axis, whereby said first and second heads are simultaneously movable along said first axis; and e. ferromagnetic powder held on said head means by the magnetic force of said head means, wherein said head means are positioned such that said ferromagnetic powder contacts said work piece whereby the movement of said head means causes the ferromagnetic powder to polish and grind said work piece.

2. The machine of claim 1, wherein said support means include means for moving said heads along said second axis, wherein the distance between said heads is variable such that said machine accomodates different size work pieces.

3. The machine of claim 1, wherein said heads are of opposite magnetic polarity.

* * * * *